United States Patent [19]

Young

[11] 4,174,507

[45] Nov. 13, 1979

[54] FOUR-PORT MAGIC TEE HAVING CAVITY STRUCTURE AT FOURTH PORT

[75] Inventor: Paul T. K. Young, Westwood, Mass.

[73] Assignee: Microwave Development Labs., Needham Heights, Mass.

[21] Appl. No.: 855,966

[22] Filed: Nov. 30, 1977

[51] Int. Cl.[2] ..... H01P 5/20

[52] U.S. Cl. ..... 333/122; 333/125

[58] Field of Search ..... 333/9, 11

[56] References Cited

U.S. PATENT DOCUMENTS

| | | | |
|---|---|---|---|
| 2,806,210 | 9/1957 | Edwards | 333/11 |
| 3,670,268 | 6/1972 | Connerney | 333/11 |
| 4,074,265 | 2/1978 | True | 333/11 X |

*Primary Examiner*—Paul L. Gensler

*Attorney, Agent, or Firm*—Wolf, Greenfield & Sacks

[57] ABSTRACT

A four port magic tee device has three ports defined by an H arm and two parallel side arms which meet at a common junction of the device, and has a fourth (E) port at the junction. Extending over the fourth port is a section of waveguide which acts as a coupling and matching structure by providing a chamber which is coupled to that port. That arrangement enables the E arm of the magic tee device to be reduced to zero length, if desired. In contrast, the E arm of a conventional magic tee of comparable performance must be of some finite length.

9 Claims, 4 Drawing Figures

FOUR-PORT MAGIC TEE HAVING CAVITY STRUCTURE AT FOURTH PORT

BACKGROUND OF THE INVENTION

The present invention relates to a four port electromagnetic coupling device which in the preferred embodiment is a waveguide magic tee. In accordance with the invention, a four port magic tee device is constructed having an E arm of very little or zero length.

Some system applications require the use of a three port device, while others require the use of a four port device. A typical three port device is a waveguide T junction. The three port T junction may be used in some applications such as where the output reflection is low or where there is no requirement for isolation between the two output arms. However, for other applications where, for example, isolation between the output arms is necessary or where the fourth arm is needed as part of the overall microwave circuit, then a four port device such as the waveguide magic tee is used.

A conventional magic tee has four arms which include an E arm, an H arm and two colinear side arms. In the conventional device the E arm, which extends out of the general plane of the other three arms, has a finite length.

For some applications where space requirements necessitate a short height it has been customary to provide a waveguide E bend in association with the E arm, but it has been found that there must be some length to the E arm in order to get acceptable performance. In contrast, in accordance with the invention, a structure has been devised wherein the E arm may be reduced to zero length to thereby make the height of the overall device appreciably smaller than the corresponding height of a conventional magic tee device of comparable performance.

Accordingly, the principal object of the present invention is to provide a magic tee whose E arm can be made to closely approach zero length.

SUMMARY OF THE INVENTION

To accomplish the foregoing and other objects of this invention there is provided a multi-port electromagnetic coupling device in the form of a magic tee constructed of a waveguide and having a plurality of arms meeting at a common junction of the device and including two aligned side arms having, in the case of a magic tee, equal power division between the side arms. The device also includes a third arm typically referred to as an H arm extending orthogonally to the side arms and which defines a third port of the device, and the device also have a fourth or E port at the junction. In the prior art this E port typically is coupled to an E arm, however, in accordance with the present invention there is provided an energy coupling and matching structure which is associated with the E port and extends over the E port. This energy coupling and matching structure is preferably in the form of a section of waveguide extending over the E port including one section extending away from one side of the E port and another section in part defining a cavity on the other side of the E port. This cavity is in part defined by a stub wall of the waveguide section spaced a predetermined distance from the edge of the fourth port. Thus, the coupling at the E port is directly through the E port to the waveguide section without the requirement for any substantial length of an E arm similar to the conventional arrangement of the E arm of the magic tee. In this way the height of the device above the E port is no more than the height of the waveguide section whereas in the prior art construction the height included a finite length of the E arm and the appropriate E bend possibly also including a small section of waveguide spacer.

It has also been found that the depth of the cavity relates inversely to the frequency of operation. In the disclosed embodiment the device is constructed of WR-90 guide sections at an operating frequency of 9.6 GHz. The cavity depth is on the order of one-tenth guide wavelength. Thus, for an operating frequency of 9.6 GHz, the corresponding wavelength is 1.683" and the cavity depth is 0.165". This is a minimum cavity depth with other periodic larger depths also providing proper matching.

DESCRIPTION OF THE DRAWINGS

Numerous other objects, features and advantages of the invention should now become apparent upon a reading of the following detailed description taken in conjunction with the accompanying drawing in which.

DETAILED DESCRIPTION

Figure 1:
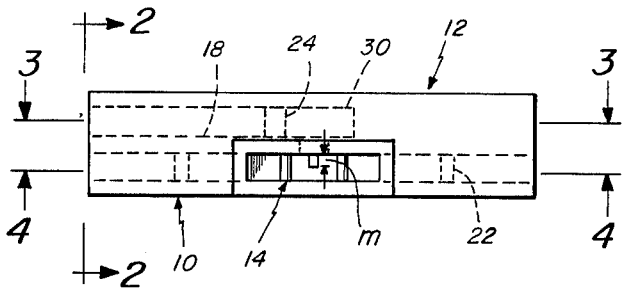
FIG. 1 is a front elevation view of a waveguide magic tee constructed in accordance with the invention looking directly into the H arm of the device.
Figure 2:
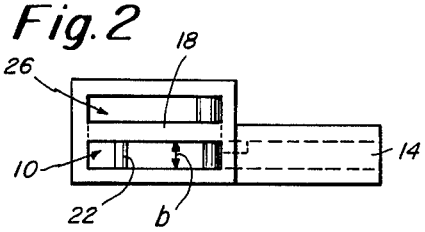
FIG. 2 is a side elevation view taken along line 2—2 of FIG. 1 as viewed looking at one of the side arms of the device.
Figure 3:
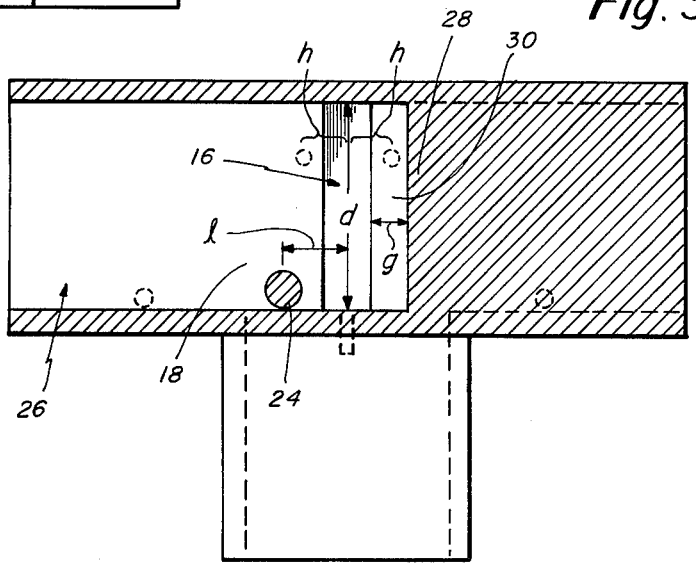
FIG. 3 is a cross sectional view taken along line 3—3 of FIG. 1.
Figure 4:
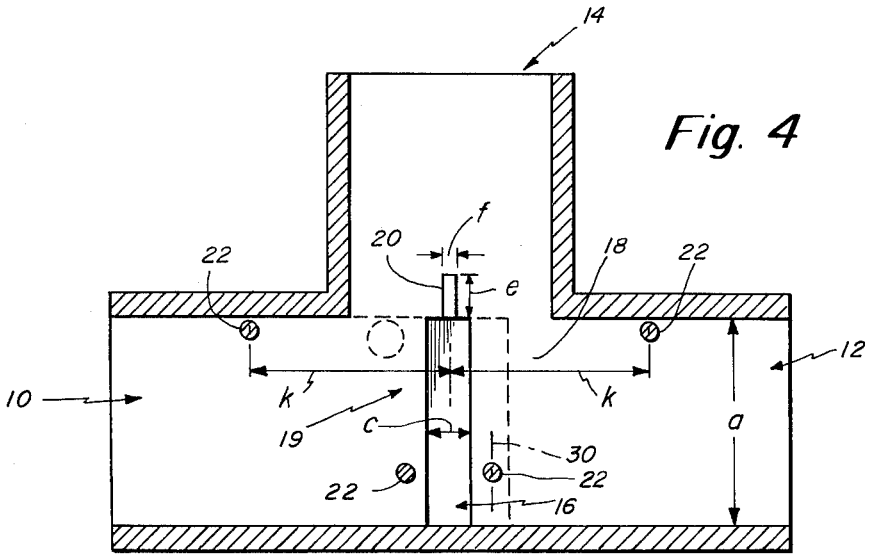
FIG. 4 is a cross sectional view taken along line 4—4 of FIG. 1.

FIGS. 1–4 depict one embodiment of the present invention in the form of a magic tee constructed from waveguide sections. This magic tee comprises side arms 10 and 12, H arm 14, and the E arm port 16 which couples through the wall 18. The three arms 10, 12 and 14 of the device all meet at common junction 19. Each of the arms 10, 12 and 14 may be constructed of a waveguide section such as a reduced height WR-90 guide section having a and b dimensions, respectively, of 0.9" and 0.2".

In the disclosed embodiment there are also provided matching structures in the form of a structure 20 adjacent one end of the port 16 in the H arm 14 and matching pins 22, four of which are used in the enclosed embodiment. In addition, one larger matching post 24 is also employed in the guide section 26 which is disposed over side arm 10. The structure 20 and the four posts 22 are primarily provided for proper performance.

The waveguide section 26 at one end overlies the E port 16 and terminates at stub wall 28 to thereby define a cavity 30 having a length comparable to the length of the port 16, a height that is the same as the height of the waveguide section 26, and a depth identified by the dimension g that has been found to be an inverse function of the operating frequency.

As previously mentioned, the device shown in FIGS. 1–4 may be constructed of reduced height WR-90 guide sections. In the drawing the dimensions a and b are, respectively, 0.9" and 0.2". The operating frequency is 9.6 GHz which corresponds to a guide wavelength of 1.683". The bandwidth of operation is from 9.4 GHz to 9.8 GHz.

The following table shows VSWR at the E and H ports and isolation at the center and two end operating frequencies:

| Frequency | H Port VSWR | E Port VSWR | Isolation |
|---|---|---|---|
| 9.4 GHz | 1.13 | 1.10 | 34 db |
| 9.6 GHz | 1.10 | 1.08 | 33 db |
| 9.8 GHz | 1.10 | 1.02 | 32 db |

The unbalance that has been measured in association with the above table is 0.15 db over the operating bandwidth.

In FIGS. 1–4 there are shown a number of dimensions associated with the device. The following table lists typical dimensions used with WR-90 guide sections:

| Reference | Dimension |
|---|---|
| a | 0.9" |
| b | 9.2" |
| c | 0.2" |
| d | 0.9" |
| e | 0.18" |
| f | 0.062" |
| g | 0.165" |
| h | 0.185" |
| k | 0.890" |
| l | 0.268" |
| m | 0.090" |

With the use of the cavity and stub wall of this invention there has been provided a good balance of power at the side arms. Also, as indicated in the first table there is a good VSWR obtained at the E and H arms. The cavity depth g is initially determined emperically by using a slidable wall 28 which may be adjusted to provide the optimum match. It has been found that the minimum depth is on the order of one-tenth wavelength of the operating frequency. Thus, for example, if the operating frequency is 8.4 GHz using WR-112 guide sections, the guide wavelength is 1.803" and the cavity depth is on the order of 0.146".

Having described one embodiment of this invention it should now be apparent that numerous other embodiments are contemplated as falling within the scope of this invention. The principles of the invention can be applied in constructing devices operating over different frequency bands by scaling the dimensions including the cavity depth dimension. Also, although the disclosed device is a 3 db magic tee it is understood that the principles of the invention may also be applied in constructing a magic tee having unequal power division. Also, the device may have a short conventional-type E arm used in association with the cavity structure.

What is claimed is:

1. A multi-port electromagnetic coupling device having a plurality of arms meeting at a common junction of the device and including two aligned side arms, each side arm defining a port of the device and have predetermined power divisions therebetween, a third arm extending orthogonally to the side arms defining a third port of the device, and the device having a fourth port at said junction; and an energy coupling and matching structure extending over said fourth port having a coupling section extending from one side of said fourth port and a matching section extending from the opposite side of said fourth port, said matching section having walls including an end wall defining a cavity open to said coupling section and having a predetermined depth extending from the edge of said fourth port on said opposite side to said end wall.

2. A multi-port electromagnetic coupling device as set forth in claim 1 wherein said cavity depth is selected as an inverse function of operating frequency of the device.

3. A multi-port electromagnetic coupling device as set forth in claim 1 wherein said cavity depth is less than the length of said cavity.

4. A multi-port electromagnetic coupling device as set forth in claim 1 wherein said coupling device is constructed with each arm comprising a section of waveguide to form a magic tee device having equal power division at the side ports.

5. A multi-port electromagnetic coupling device as set forth in claim 4 wherein said energy coupling and matching structure comprises a section of waveguide having a stub wall forming the end wall.

6. A multi-port electromagnetic coupling device as set forth in claim 5 wherein said waveguide section that comprises the coupling and matching structure overlies one of the side arms and has substantially the same dimensions as the side arm.

7. A multi-port electromagnetic coupling device as set forth in claim 5 wherein said cavity has a length comparable to the width of the waveguide section, a height comparable to the height of the waveguide section and a depth on the order of one-tenth wavelength of the operating frequency.

8. A multi-port electromagnetic coupling device as set forth in claim 1 wherein said cavity depth is on the order of one-tenth wavelength of the operating frequency.

9. A multi-port electromagnetic coupling device as set forth in claim 8 wherein said one-tenth wavelength represents a minimum depth whereby other depths exist where balance is obtained at depths greater than one-tenth wavelength.

* * * * *